US011560206B1

(12) United States Patent
Watts

(10) Patent No.: US 11,560,206 B1
(45) Date of Patent: Jan. 24, 2023

(54) STERN LIGHT

(71) Applicant: Nathaniel Chad Watts, Trussville, AL (US)

(72) Inventor: Nathaniel Chad Watts, Trussville, AL (US)

( * ) Notice: Subject to any disclaimer, the term of this patent is extended or adjusted under 35 U.S.C. 154(b) by 0 days.

(21) Appl. No.: 17/461,063

(22) Filed: Aug. 30, 2021

Related U.S. Application Data

(60) Provisional application No. 63/071,978, filed on Aug. 28, 2020.

(51) Int. Cl.

| | |
|---|---|
| ***B63B 45/04*** | (2006.01) |
| ***F21V 3/06*** | (2018.01) |
| ***F21V 21/22*** | (2006.01) |
| ***F21V 23/00*** | (2015.01) |
| ***F21Y 115/10*** | (2016.01) |
| ***F21W 107/20*** | (2018.01) |

(52) U.S. Cl.
CPC ..... *B63B 45/04* (2013.01); *F21V 3/062* (2018.02); *F21V 21/22* (2013.01); *F21V 23/001* (2013.01); *F21W 2107/20* (2018.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 6,981,777 | B2 * | 1/2006 | Barnes | F21K 2/06 362/546 |
| 8,545,046 | B2 * | 10/2013 | Ng | B63B 45/04 362/477 |
| 9,908,597 | B1 * | 3/2018 | Benson | F21V 23/06 |
| 2013/0092074 | A1 * | 4/2013 | Larouche | B63B 45/04 116/26 |
| 2015/0274267 | A1 * | 10/2015 | Deven | B63B 45/04 29/850 |

FOREIGN PATENT DOCUMENTS

KR 20180083707 A * 8/2018

* cited by examiner

*Primary Examiner* — Alan B Cariaso
(74) *Attorney, Agent, or Firm* — C. Brandon Browning; Maynard Cooper & Gale, PC

(57) ABSTRACT

The present disclosure is directed to a stern light for illuminating a watercraft without visually impairing a passenger of the watercraft. The stern light includes a flexible pole with a hollow interior for housing wires. The wires are connected to a watercraft at one end of the pole and to a light source at another end of the pole. The light source, which may be an LED light source, is covered by a globe that at least partially refracts light. When powered, the stern light produces light capable of providing visibility of the watercraft for at least two nautical miles while also avoiding the visual impairment of watercraft passengers. Pole flexibility allows operation of the stern light during watercraft motion and in areas with potential obstructions, such as low-hanging branches.

18 Claims, 16 Drawing Sheets

STERN LIGHT

RELATED APPLICATIONS

This application claims priority to U.S. Provisional Patent Application No. 63/071,978 filed on Aug. 28, 2020, titled "Stern Light", the entire contents of which are incorporated herein.

TECHNICAL FIELD

The present invention is directed to a stern light for providing watercraft visibility in low light conditions.

BACKGROUND OF INVENTION

Utilizing a watercraft in low light conditions renders the need for a light source. Such a light source may be legally required for watercraft operation and should generally be visible for at least two nautical miles. However, some watercraft activities, such as fishing, can be negatively affected by stern lights whose brightness interferes with an individual's vision. Further, a stern light must withstand watercraft operation and vibration while remaining at a height and position to provide the necessary illumination for visibility and navigation.

The present disclosure generally describes a stern light made from a flexible pole material and having a milk white globe. The pole is flexible so that the stern light is correctly positioned while the watercraft is in operation, even under turbulent water conditions. Additionally, the pole is at least partially retractable so that the stern light can adjusted and stored. The globe's composition of multiple plastics allows light from an LED bulb within to be refracted, so that the entirety of the watercraft may be illuminated and the watercraft is visible up to two nautical miles. Furthermore, the globe permits light that is not so bright as to obstruct the vision of individuals on the watercraft, allowing activities, such as nighttime fishing, to be undertaken in comfortable vision conditions.

SUMMARY OF THE INVENTION

The present invention is directed to a stern light for providing watercraft visibility. In one aspect of the invention, there is provided a stern light assembly for a watercraft. The stern light assembly includes a flexible pole with a hollow interior, the hollow interior housing wires that span a length of the pole and terminate in a housing at a watercraft end of the pole and a light base at a light end of the pole. A pole base is located at the watercraft end and configured to attach the stern light to a stern of the watercraft. A light source is communicably coupled to wires at the light base and attached to a socket of the light base. Further, a globe is coupled to the light base and covers the light source. The stern light is configured to produce light that illuminates the watercraft for a distance of at least two nautical miles without visually impairing a user of the watercraft. In some embodiments, the pole is configured to be extended and retracted. In some instances, the pole includes a telescoping point for pole extension and retraction. In some embodiments, the pole has a taper with a largest diameter at the watercraft end and a smallest diameter at the light end. In some instances, the taper is a constant 0.25 inch taper. In some embodiments, the pole is composed of carbon fiber and the length of the pole is more than nine feet. In some embodiments, the light source is an LED bulb and the globe is milk white. In some embodiments, the globe is composed of a mixture of plastics that at least partially refracts light.

In another aspect of the disclosure, there is provided a stern light kit. The kit includes a plurality of wires and a pole. The pole has a watercraft end, a light end, and a hollow interior for housing the wires. The kit further includes a housing configured to house wire terminals of the wires at the watercraft end of the pole and a pole base configured to couple the watercraft end of the pole to a stern of a watercraft. A light base with a socket is configured to communicably couple a light source to wires the light end of the pole. The kit also includes a globe configured to couple with the light base and cover the light source. The globe is configured to permit light emission from the light source that illuminates the watercraft for a distance of at least two nautical miles without visually impairing a user of the watercraft. In some embodiments, the pole is configured to be extended and retracted. In some instances, the pole includes a telescoping point for pole extension and retraction. In some embodiments, the pole has a taper with a largest diameter at the watercraft end and a smallest diameter at the light end. In some instances, the taper is a constant 0.25 inch taper. In some embodiments, the pole is composed of carbon fiber and the length of the pole is more than nine feet. In some embodiments, the light source is an LED bulb and the globe is milk white. In some embodiments, the globe is composed of a mixture of plastics that at least partially refracts light.

A further understanding of the nature and advantages of the present invention will be realized by reference to the remaining portions of the specification and the drawings.

BRIEF DESCRIPTION OF DRAWINGS

The present disclosure same can be better understood, by way of example only, with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION OF THE INVENTION

The present disclosure is directed to a stern light. The stern light has notable features including a flexible and retractable pole and a milk white globe. The pole is flexible so that the stern light is configured to operate under normal watercraft operation conditions, including in turbulent water or during watercraft movement. The pole's ability to be retracted allows for adjustable positioning and the ability for the stern light to be stored when not in use. The globe surrounds an LED bulb so that light emitted is sufficiently bright to be visible for at least two nautical miles, as is legally required in some circumstances, such as during nighttime operation. However, the globe also refracts light such that the entire watercraft is illuminated without visually impairing individuals on the watercraft. As such, the stern light of the present disclosure permits legal visibility and navigation of a watercraft in low light conditions while also allowing the practice of activities, such as fishing, with visual comfort for the practitioner.

As used herein, the term "watercraft" refers to any vehicle with a propulsion capability that is operable in water. Examples of watercraft include, but are not limited to, boats, ships, and personal watercraft (e.g. jet skis).

Figure 1:
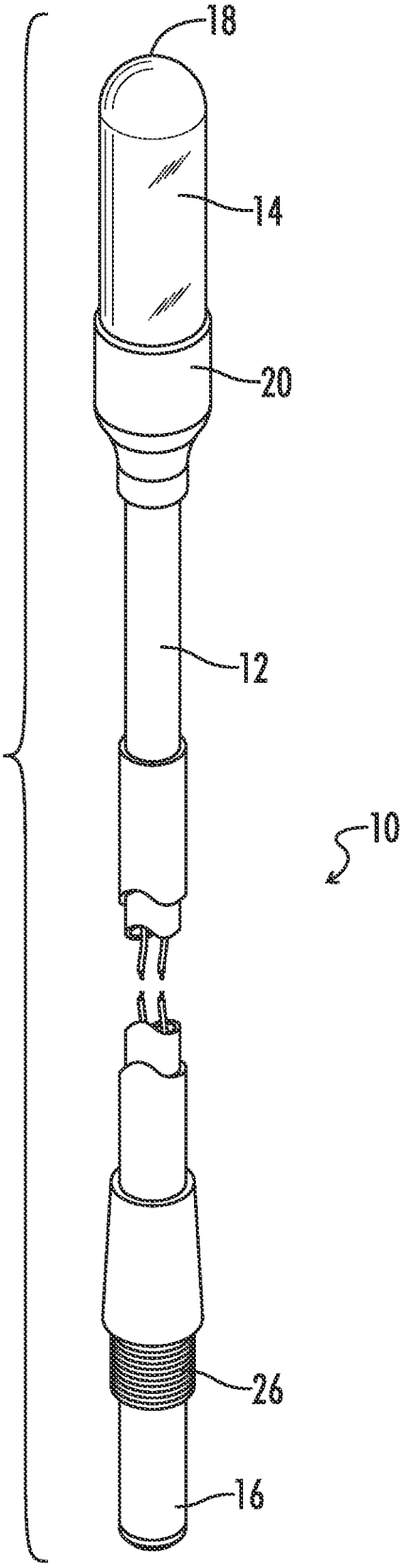
FIG. 1 is a top perspective view schematic of the stern light of the present disclosure.
Figure 2:
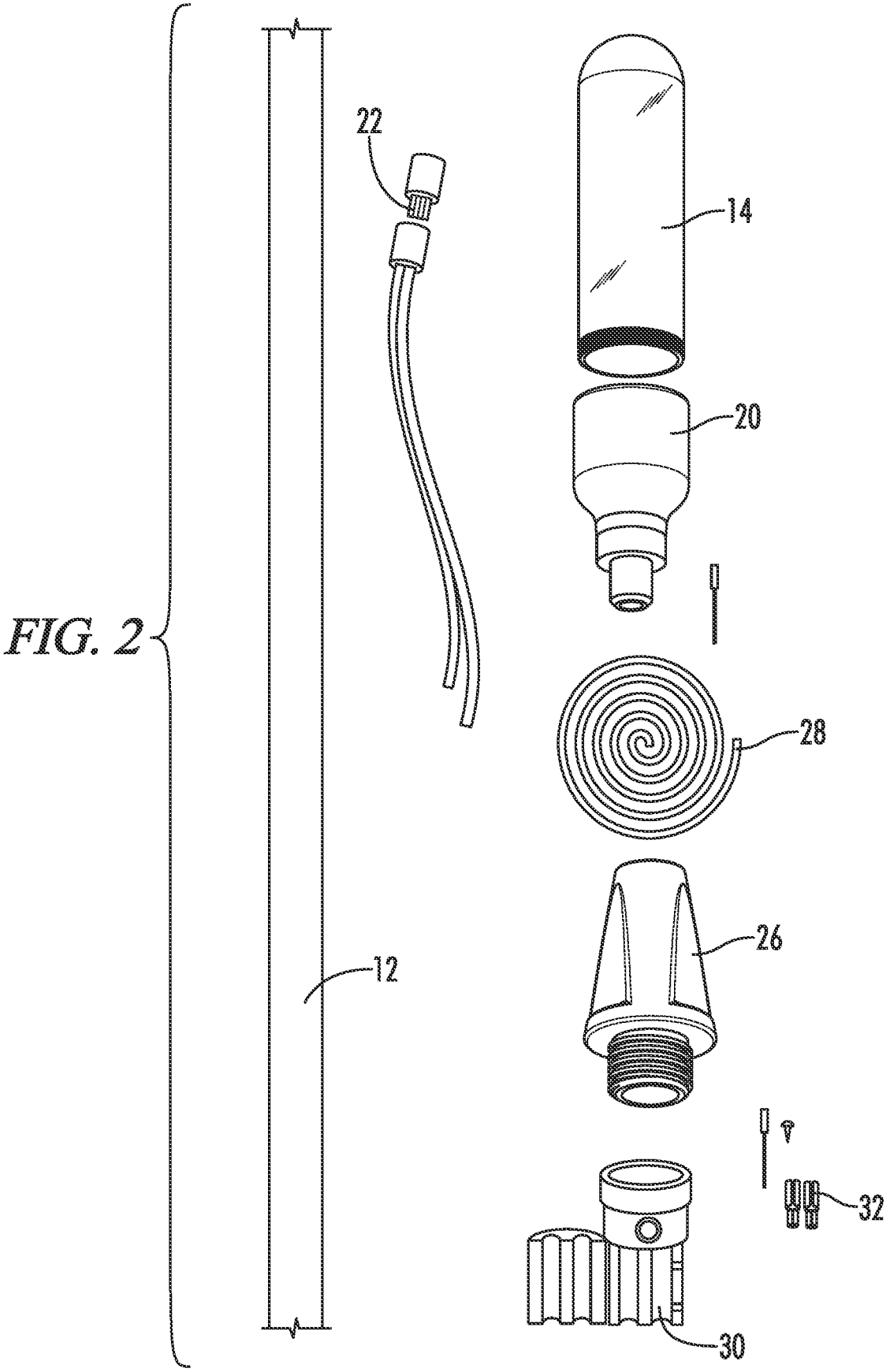
FIG. 2 is a perspective view schematic of the disassembled components of the stern light of FIG. 1.
Figure 3:
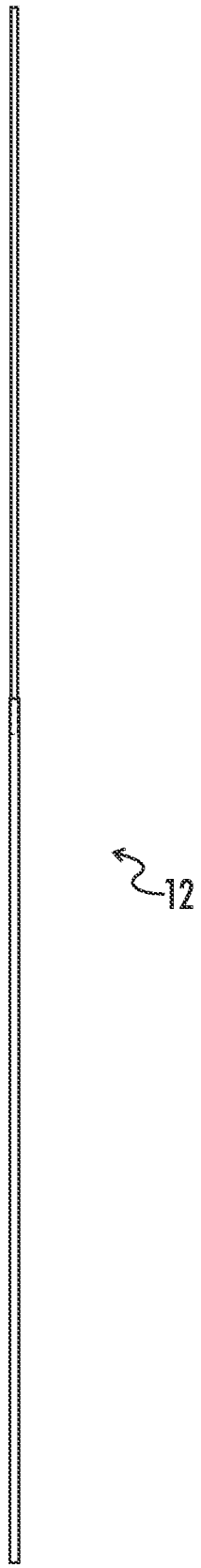
FIG. 3 is an elevational view schematic of the pole of the stern light of FIG. 1.
Figure 14:
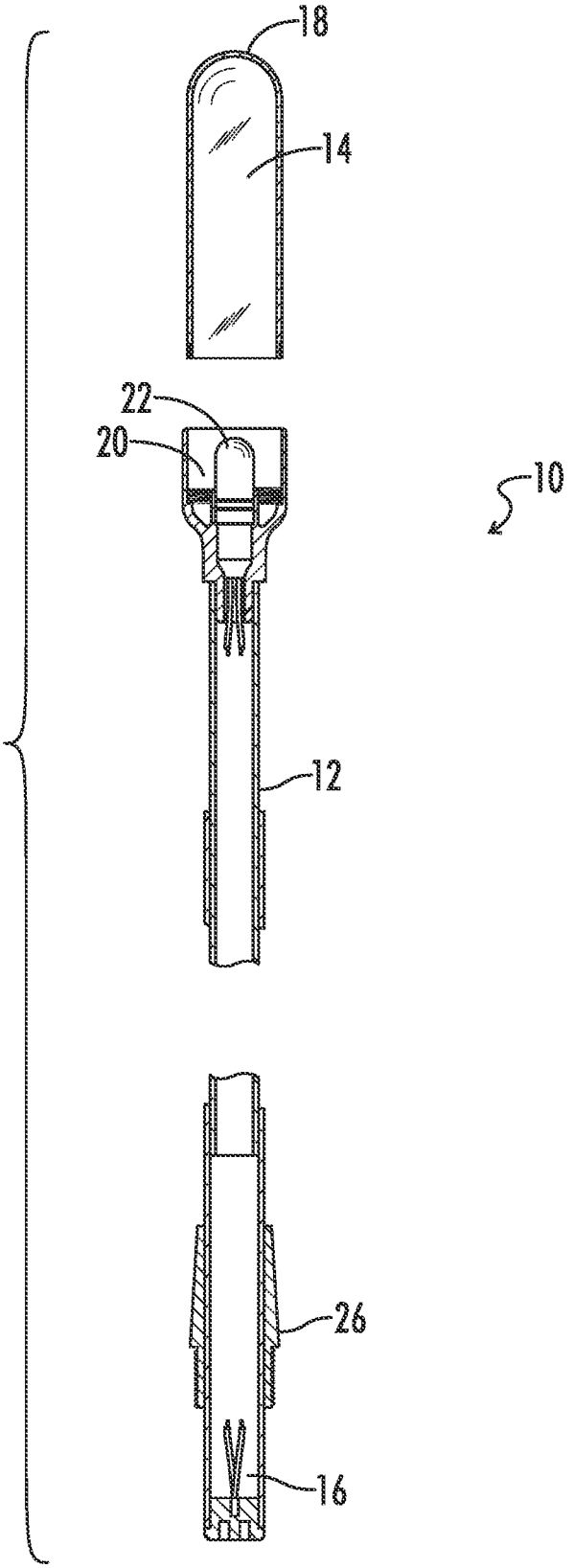
FIG. 14 is a sectional view schematic of the stern light of FIG. 1.
Figure 15:
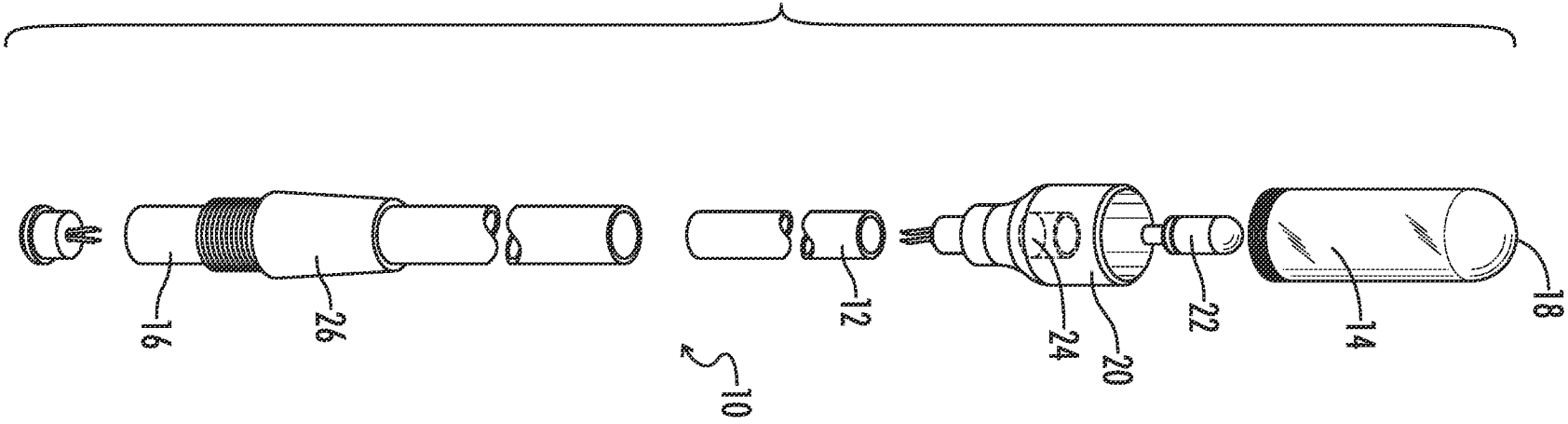
FIG. 15 is an exploded perspective view schematic of the stern light of FIG. 1.
Figure 16:
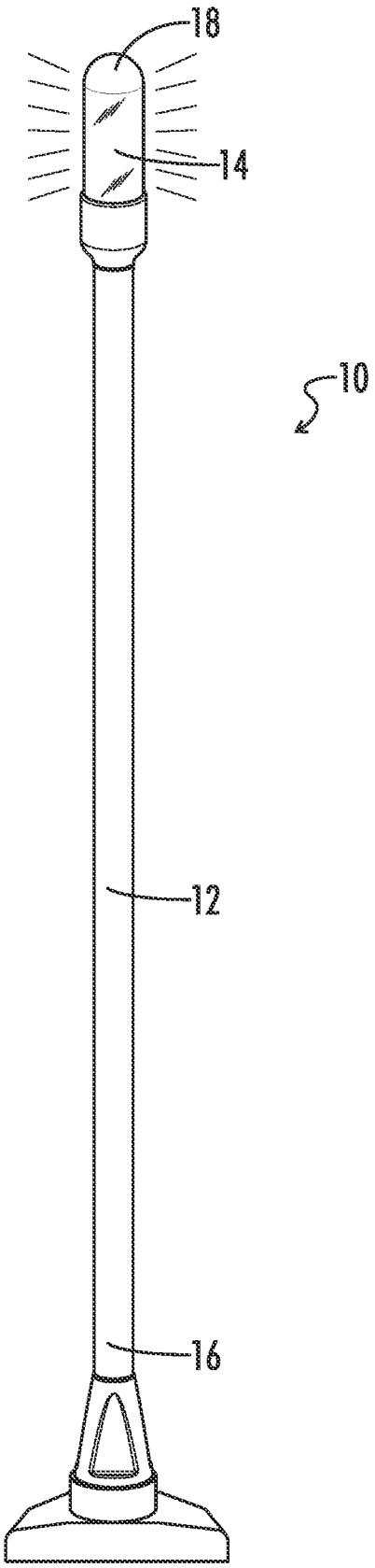
FIG. 16 is a perspective view schematic of the illuminated stern light of FIG. 1.

The stern light is depicted as an assembly and as disassembled components in FIG. 1 and FIG. 2, respectively. FIG. 3 depicts the flexible pole, with wiring spanning the pole's interior depicted in FIG. 4. FIGS. 5-8 show components of the watercraft end of the pole, while FIGS. 9-13 are directed to components of the light end of the pole. FIGS. 14-16 are various views of the assembled stern light.

Referring to FIG. 1, a stern light 10 is depicted. Stern light 10 includes a carbon-fiber pole 12 that extends from a watercraft end 16 to a globe 14 at a light end 18. Pole 12 includes a light base 20 near light end 18 that contains a light source 22 within a socket 24. Globe 14 screws into socket 24 and covers light source 22. At watercraft end 16, pole 12 includes a watercraft base 26 configured to attach stern light 10 to the watercraft. Detailed descriptions of these components are included below.

Now referring to FIG. 2, the components of unassembled stern light 10 are displayed. Stern light 10 is assembled from these components such that wires 28 run from a housing 30 at watercraft end 16 to light source 22 at light end 18. Additional components of wire terminals 32 and securing hardware are shown in FIG. 2 as well. The assembly process for stern light 10 is detailed below.

Now referring to FIG. 3, stern light 10 includes a carbon-fiber pole 12. In some embodiments, pole 12 is configured to be retracted at least at one point along pole 12. This retraction point is shown at approximately the midpoint of pole 12 in FIG. 3, though the location along stern light 10 is closer to watercraft end 16 in some instances or closer to light end 18 in other instances not depicted. In one embodiment, the retraction point allows stern light 10 to be extended to approximately 9.5 feet and retracted to approximately 5 feet, though other lengths of extension and retraction are compatible with the present disclosure. The retraction occurs through telescoping in some embodiments, such as the embodiment depicted in FIG. 3, though other retraction means, such as folding or disassembly, are possible in embodiments not shown. The diameter of pole 12 is such that retraction is possible. For instance, pole 12 has two inner diameters in some embodiments, such that the section of pole 12 closest to watercraft end 16 has a greater inner diameter than the outer diameter of the section of pole 12 closest to light end 18. As such, the section of pole 12 closest to light end 18 fits within and is configured to be retracted into the section of pole 12 closest to watercraft end 16. In some embodiments, pole 12 is tapered so that the sections closest to watercraft end 16 have a greater outer diameter than the sections closest to light end 18. In some instances, this taper is a constant 0.25 inch taper. The taper allows more flexibility of pole 12, the advantages of which are discussed below. In some embodiments, pole 12 is not retractable.

The composition of pole 12 is carbon-fiber, which allows flexibility for stern light 10 operation in turbulent conditions. Additionally, this flexibility allows stern light 10 to be in contact with some obstructive objects, such as tree branches, without substantial damage. Flexibility from taper and composition allow pole 12 to withstand other forces, such as from wind and/or watercraft motion. Other composition materials that impart flexibility to pole 12 are compatible with the present disclosure. Thus, due to the strength and flexibility of pole 12, stern light 10 is configured to remain extended when watercraft is in motion at high speeds, which eliminates the need to retract or collapse stern light 10 between different watercraft locations.

Figure 4:
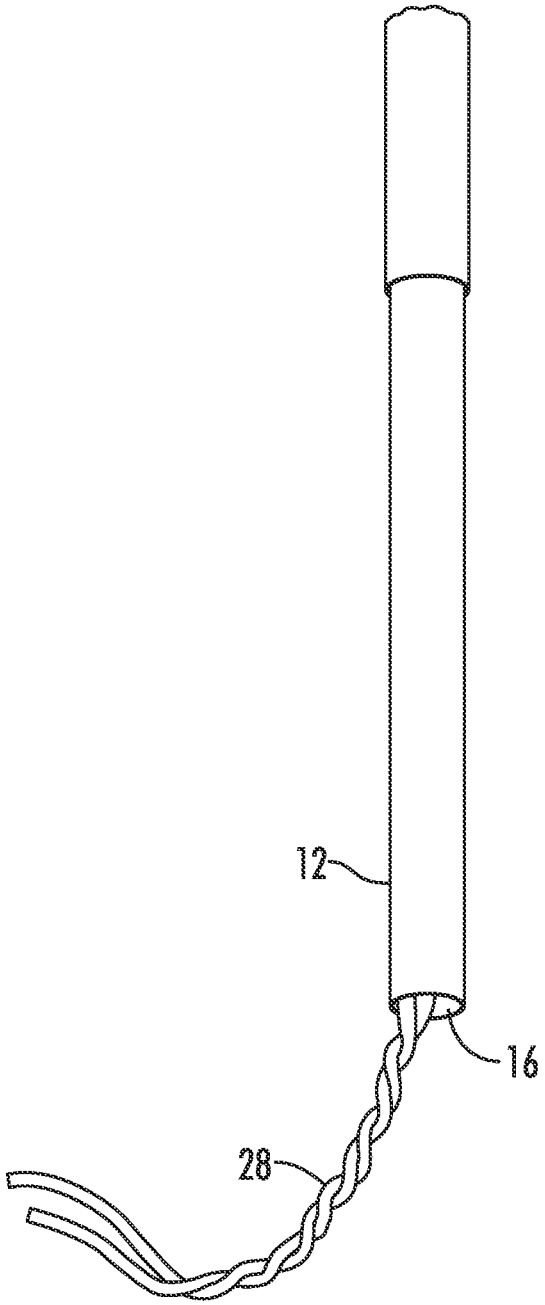
FIG. 4 is a perspective view schematic depicting wires extending throughout the interior of the pole of the stern light of FIG. 1.

In FIG. 4, a stage of stern light 10 assembly is depicted, with wires 28 placed in a hollow interior of pole 12. Wires 28 are included to power light source 22 and connect to the watercraft electrical system at watercraft end 16 of stern light 10. Thus, wires 28 span the length of pole 12 and are at least partially contained within the hollow interior of pole 12. Wires 28 are commercially available and communicably coupled to the watercraft and bulb housings as is known in the art.

Figure 5:
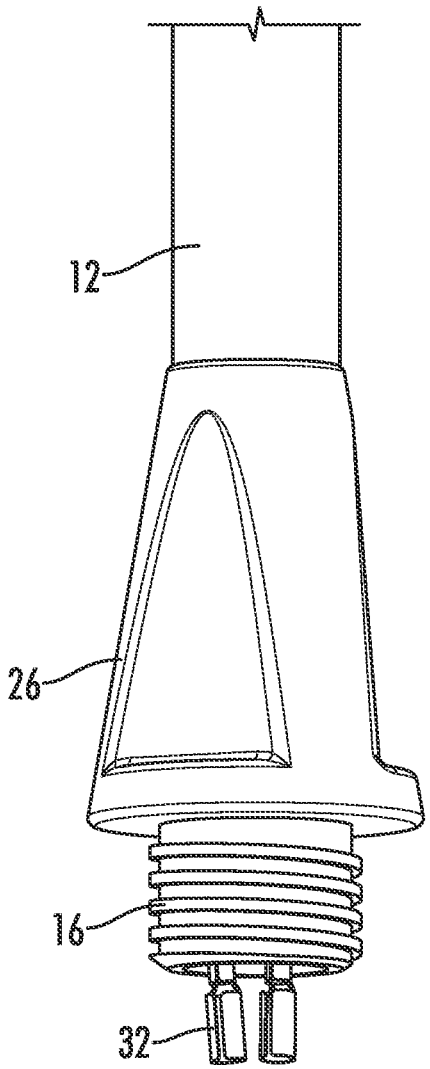
FIG. 5 is a perspective view schematic depicting wires with wire terminals and the pole base at the watercraft end of the stern light of FIG. 1.

In FIG. 5, a step in the stern light assembly process is depicted, with wire terminals 32 added to wires 28 at watercraft end 16 of pole 12. Watercraft base 26 is also attached near watercraft end 16, as shown. Watercraft base 26 is positioned about the exterior of pole 12 and includes threads compatible with the threading in insertion points on the sterns of watercrafts. In such a way, watercraft base 26 is configured to be inserted and screwed into the stern of a watercraft so that stern light 10 is positioned and extends upwards from the stern of the watercraft. The threading of watercraft base 26 is varied to be compatible with different threading of its intended insertion point in some embodiments. The height along pole 12 at which watercraft base 26 is positioned is closer or farther from watercraft end 16 in embodiments not depicted. Watercraft base 26 is composed of plastic, though other materials, such as metal, are compatible with the present disclosure.

Figure 6:
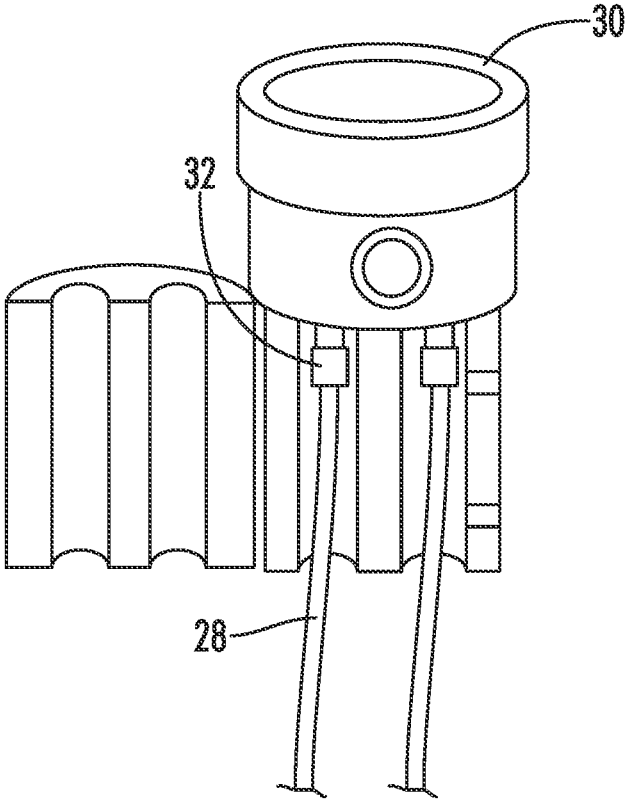
FIG. 6 is a perspective view schematic depicting wires attached to a housing at the watercraft end of the stern light of FIG. 1.

In FIG. 6, wire terminals 32 are placed into housing 30 at watercraft end 16 of pole 12. Housing 30 includes points of attachment for wire terminals 32. While two wires 28 with wire terminals 32 are shown in this embodiment, more wires 28 and wire terminals 32 are compatible with the present disclosure. The composition of housing 30 is plastic, though other housing materials are compatible with the present disclosure. After wires 28 and wire terminals 32 positioned, housing 30 is closed and/or secured so that wires 28 and wire terminals 32 are maintained in the desired location.

Figure 7:
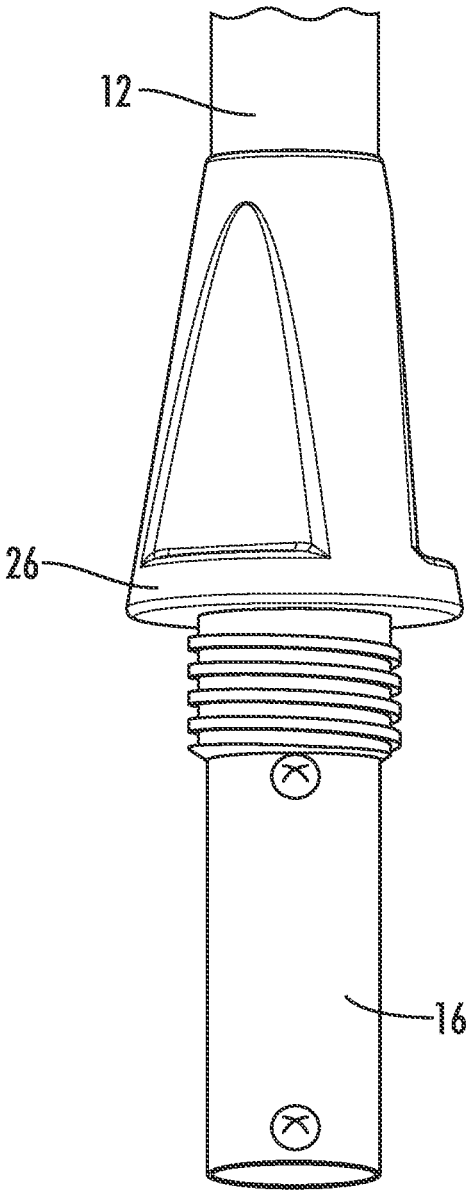
FIG. 7 is a perspective view schematic depicting the housing and pole base secured to the watercraft end of the stern light of FIG. 1.
Figure 8:
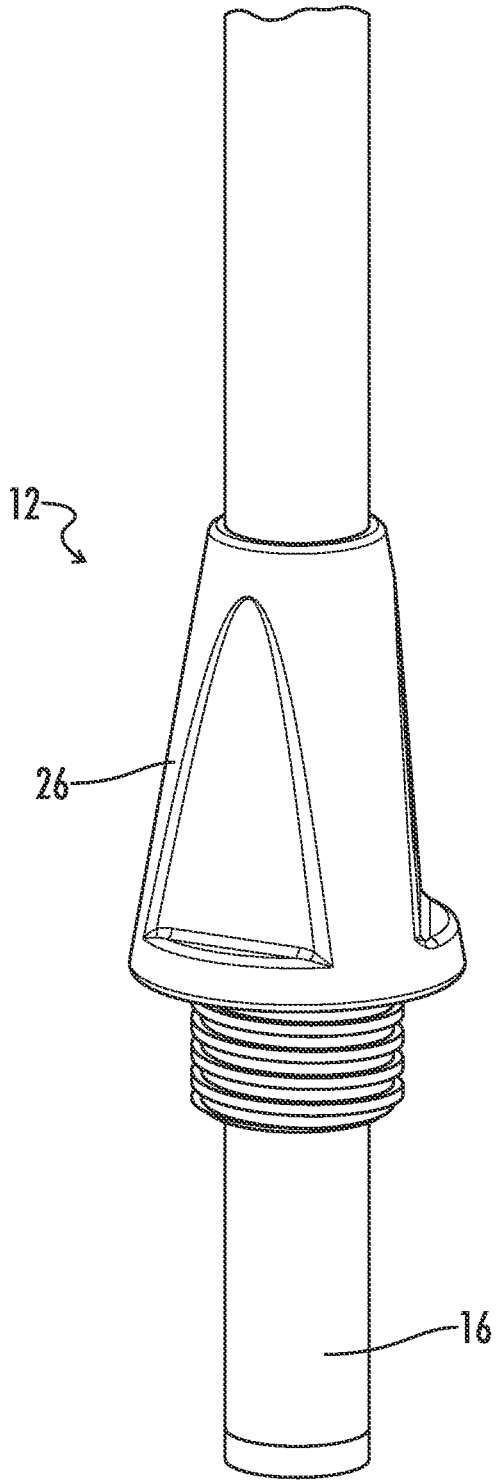
FIG. 8 is a perspective view schematic of the assembled watercraft end of the stern light of FIG. 1.

Now referring to FIG. 7, securing hardware is inserted into watercraft end 16 of pole 12 so that watercraft base 26 and housing 30 are immobilized in their intended positions. The securing hardware includes screws, pins, pegs, nails, or other materials capable of holding watercraft base 26 and housing 30 in their intended positions. In FIG. 8, the assembled components on watercraft end 16 of pole 12 are shown.

Figure 9:
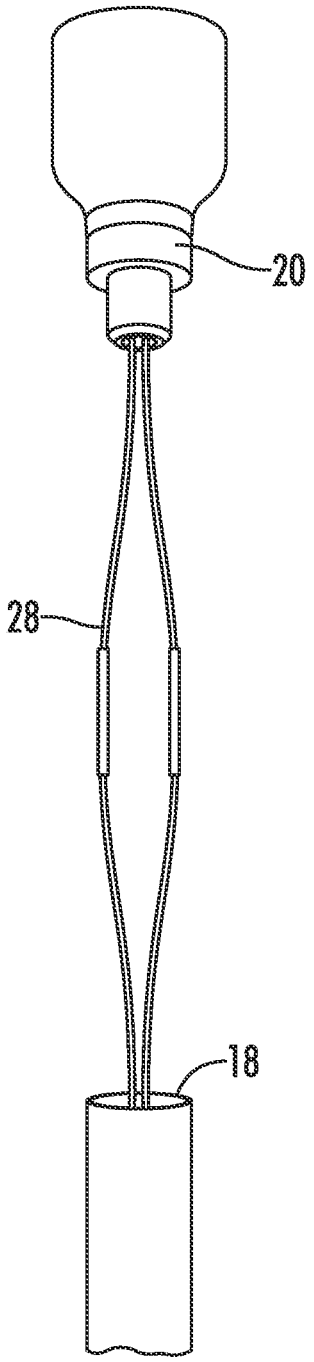
FIG. 9 is a perspective view schematic displaying self-solder heat shrink connecters connecting the wires at the light end of the stern light of FIG. 1.

In FIG. 9, steps for the assembly of stern light 10 is depicted at light end 18. Wires 28 extending through light end 18 are further connected to light base 20 for powering light source 22. The connection of wires 28 involves the use of self-solder heat shrink connecters or similar connection means, as is well known in the art. For example, a heat gun may be used to shrink the connectors. A connection is formed such that wires 28 are communicably coupled from pole 12 to socket 24, which is inserted in light base 20. Socket 24 is rubber and includes threading configured to accept the threading of globe 14. Socket 24 is configured to prevent water from entering wire 28 and light source 22 connections.

Figure 10:
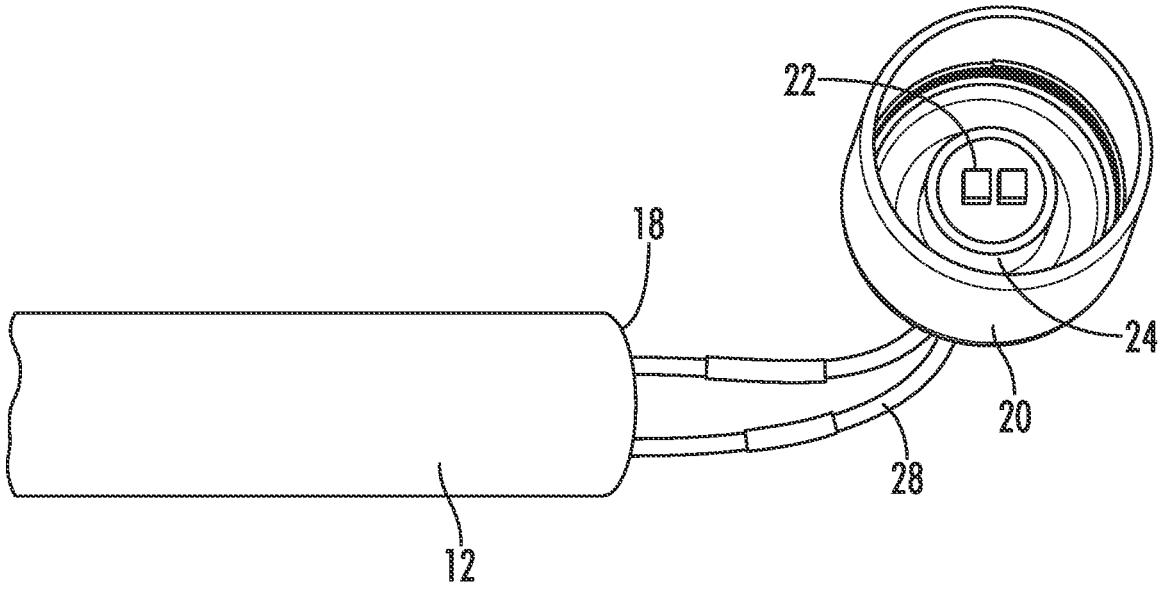
FIG. 10 is a perspective view schematic displaying the placement of the LED bulb within the light base of the stern light of FIG. 1.

In FIG. 10, light base 20 is shown with light source 22 attached. Light base 20 is plastic, though other materials are compatible with the present disclosure. Light base 20 contains socket 24 and is configured to be positioned at light end 18 of pole 12. Wires 28 from socket 24 are in communication with wires connected to housing 30, such that the watercraft powers light source 22 in socket 24 when stern light 10 is attached to the stern of the watercraft. The dimensions and features of light base 20 are described in more detail below. Light source 22 is any source of light capable of being powered by the watercraft or a power source on or within the watercraft. Light source 22 is, in some embodiments, a bulb such as an LED bulb. In some embodiments, light source 22 is a 350 lumen Cree LED bulb designed with fluted fins to dissipate heat. However, other light sources or LED bulbs are compatible with the present disclosure when they include threading to screw into counterpart threading of socket 24 or other means of attaching to socket 24.

Figure 11:
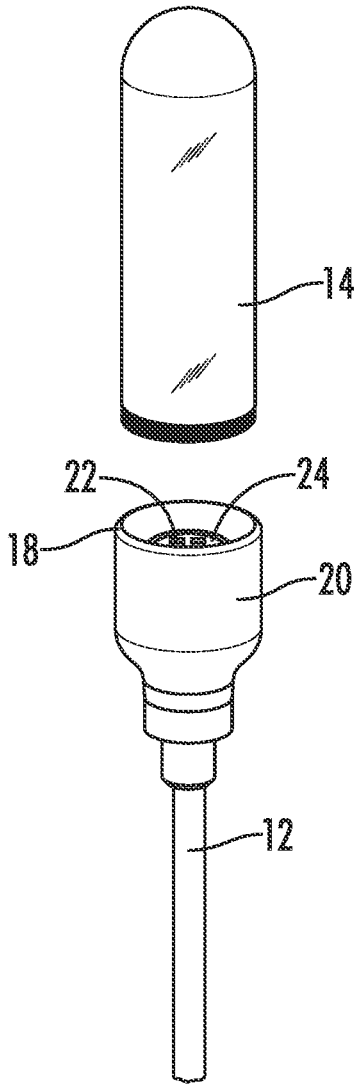
FIG. 11 is a perspective view schematic displaying the attachment of the globe of the stern light of FIG. 1.

Now referring to FIG. 11, attached light base 20 with light source 22 is connected with globe 14. The position of light base 20 is secured using securing hardware, which is one or more screws, pins, nails, pegs, or other components capable of attaching light base 20 to pole 12. Wires 28 remain in the interior of stern light 10, as they are enclosed in the hollow interior of pole 12 and light base 20. Light base 20 further includes threading compatible with the threading of globe 14, such that globe 14 is configured to be attached to light base 20 by screwing into light base 20.

Figure 12:
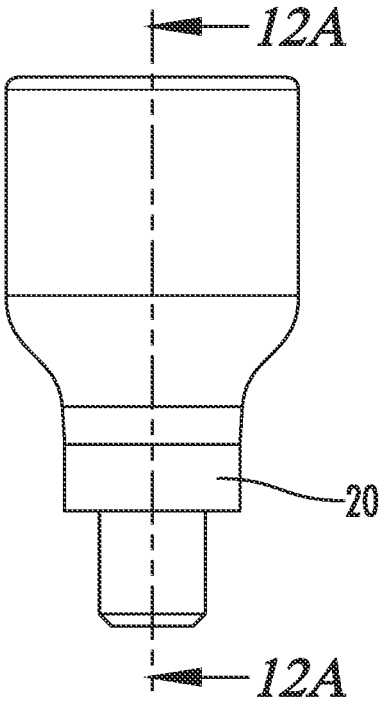
FIG. 12 are elevational and sectional view schematics of the light base of the stern light of FIG. 1, where the sectional view is with respect to line 12A in the elevational view.
Figure 12A:
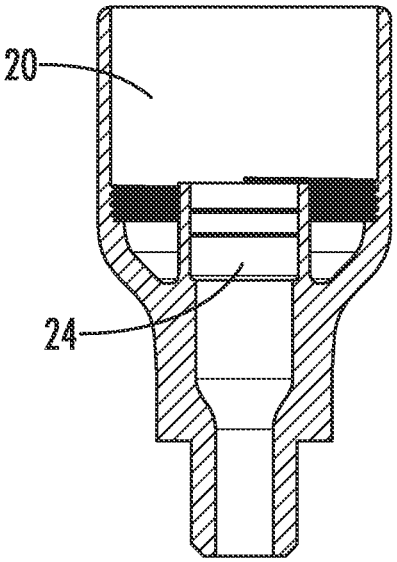

In FIG. 12, a detailed schematic of light base 20 is depicted. In the sectional view in FIG. 12A along line 12A of FIG. 12, the placement of socket 24 is shown in light base 20, with the threads of socket 24 facing the wide opening of light base 20. This wide opening of light base 20 is for reception of globe 14 and is threaded for such purpose. The narrower opening of light base 20 allows the fitting with pole 12 at light end 18. The diameters of the openings of light base 20 are such that pole 12 fits in the narrow opening and globe 14 fits in the wide opening with the capability of being screwed into the threading within the wide opening. The dimensions of light base 20 accommodate socket 24 and light source 22 fitting within.

Figure 13:
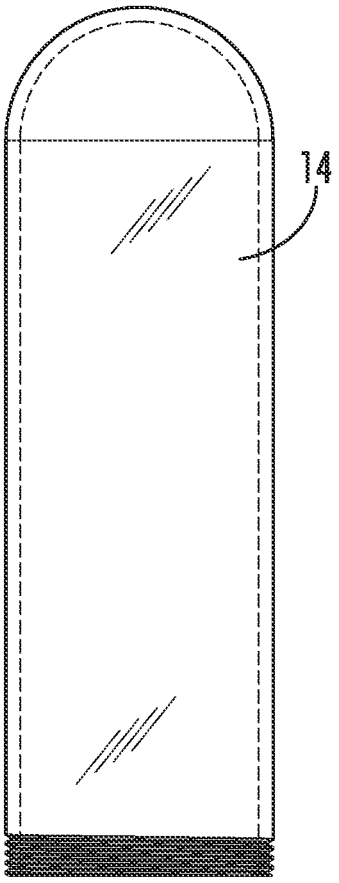
FIG. 13 is a side elevational view schematic of the globe of the stern light of FIG. 1.

Now referring to FIG. 13, globe 14 is depicted. Globe 14 is shown with threading that matches the threading in the wide opening of light base 20. Thus, globe 14 is configured to screw into light base 20 and cover the wide opening. As light base 20 is opaque, light produced by light source 22 within light base 20 passes through globe 14 when globe 14 is screwed into light base 20. The height of globe 14 varies, and heights other than those depicted in the embodiment in FIG. 13 are compatible with the present disclosure. The diameter of globe 14 is such that the threaded region is capable of screwing into light base 20. Curvature at the top of globe 14 other than that depicted in FIG. 13 is compatible with the present disclosure.

Globe 14 is composed of a mixture of plastics and is milk white, so that light is at least partially refracted. In some cases, the mixture is one of three plastics and includes at least one pigment to produce the milk white color. The plastics absorb more light than they permit to pass through, reducing the intensity of the light produced by light source 22. Thus, light emitted through globe 14 is sufficiently bright to be visible at a distance of at least two nautical miles, permits visibility of the entire watercraft on which stern light 10 is connected, yet does not cause visual impairment of an individual on the watercraft. In this way, an individual using stern light 10 is capable of carrying out activities in low light conditions and complying with requirements for nighttime navigation of the watercraft, while not being hindered from performing activities by overly-bright light.

Referring to FIG. 14, a schematic of the assembled stern light 10 is shown. Light source 22 is configured to be covered by globe 14 at light end 18 of pole 12, while watercraft base 26 is provided at watercraft end 16 of pole 12 for attachment to the stern of a watercraft. FIG. 15 shows an exploded perspective view of stern light 10 and its components.

Referring now to FIG. 16, a schematic depicting an operating stern light 10 is shown. While stern light 10 in FIG. 16 is not depicted as attached to a watercraft, attachment to a watercraft stern is possible at watercraft end 16 of stern light 10. Stern light 10 is illuminated, with light that is emitted from LED light source 22 and that passes through globe 14.

As will be understood by those familiar with the art, the present invention may be embodied in other specific forms without departing from the spirit or essential characteristics thereof. Accordingly, the disclosures and descriptions herein are intended to be illustrative, but not limiting, of the scope of the invention which is set forth in the following claims.

I claim:

1. A stern light assembly for a watercraft, the stern light assembly comprising:

a flexible pole with a hollow interior, the hollow interior housing wires that span a length of the pole and terminate in a housing at a watercraft end of the pole and a light base at a light end of the pole;

a pole base located at the watercraft end and configured to attach the stern light to a stern of the watercraft;

a light source communicably coupled to wires at the light base and attached to a socket of the light base; and a globe coupled to the light base and covering the light source, wherein the stern light is configured to produce light that illuminates the watercraft for a distance of at least two nautical miles without visually impairing a user of the watercraft, and wherein the globe is composed of a mixture of plastics that at least partially refracts light.

2. The stern light assembly of claim 1, wherein the pole is configured to be extended and retracted.

3. The stern light assembly of claim 2, wherein the pole includes a telescoping point for pole extension and retraction.

4. The stern light assembly of claim 1, wherein the pole has a taper with a largest diameter at the watercraft end and a smallest diameter at the light end.

5. The stern light assembly of claim 4, wherein the taper is a constant 0.25 inch taper.

6. The stern light assembly of claim 1, wherein the pole is composed of carbon fiber.

7. The stern light assembly of claim 1, wherein the length of the pole is more than nine feet.

8. The stern light assembly of claim 1, wherein the light source is an LED bulb.

9. The stern light assembly of claim 1, wherein the globe is milk white.

10. A stern light kit comprising:

a plurality of wires;

a pole having a watercraft end and a light end, the pole including a hollow interior for housing the wires;

a housing configured to house wire terminals of the wires at the watercraft end of the pole;

a pole base configured to couple the watercraft end of the pole to a stern of a watercraft;

a light base with a socket configured to communicably couple a light source to wires the light end of the pole; and a globe configured to couple with the light base and cover the light source, wherein the globe is configured to permit light emission from the light source that illuminates the watercraft for a distance of at least two nautical miles without visually impairing a user of the watercraft, wherein the globe is composed of a mixture of plastics that at least partially refracts light.

11. The stern light kit of claim 10, wherein the pole is configured to be extended and retracted.

12. The stern light kit of claim 11, wherein the pole includes a telescoping point for pole extension and retraction.

13. The stern light kit of claim 10, wherein the pole has a taper with a largest diameter at the watercraft end and a smallest diameter at the light end.

14. The stern light kit of claim 13, wherein the taper is a constant 0.25 inch taper.

15. The stern light kit of claim 10, wherein the pole is composed of carbon fiber.

16. The stern light kit of claim 10, wherein the length of the pole is more than nine feet.

17. The stern light kit of claim 10, wherein the light source is an LED bulb.

18. The stern light kit of claim 10, wherein the globe is milk white.

* * * * *